United States Patent [19]

Focke et al.

[11] Patent Number: 4,524,658

[45] Date of Patent: Jun. 25, 1985

[54] APPARATUS FOR PRODUCING PACKAGING BLANKS

[75] Inventors: Heinz Focke; Kurt Liedtke, both of Verden, Fed. Rep. of Germany

[73] Assignee: Focke & Co., Verden, Fed. Rep. of Germany

[21] Appl. No.: 541,638

[22] Filed: Oct. 13, 1983

[30] Foreign Application Priority Data

Nov. 11, 1982 [DE] Fed. Rep. of Germany ..... 3241636

[51] Int. Cl.[3] ..... B31B 23/00; B65B 41/12; B65B 19/02; B26D 7/06

[52] U.S. Cl. ..... 83/152; 53/389; 83/175; 83/323; 83/349; 83/422

[58] Field of Search ..... 53/389; 83/98–100, 83/152, 155, 322, 323, 349, 422, 424, 175

[56] References Cited

U.S. PATENT DOCUMENTS

| | | | |
|---|---|---|---|
| 1,393,524 | 10/1921 | Grupe | 83/346 X |
| 2,141,574 | 12/1938 | Wamser | 83/349 X |
| 3,143,016 | 8/1964 | Obenshain | 83/349 X |
| 4,041,816 | 8/1977 | Shearon | 83/100 |
| 4,151,699 | 5/1979 | Focke et al. | 53/389 X |

*Primary Examiner*—James M. Meister

*Attorney, Agent, or Firm*—Sughrue, Mion, Zinn, Macpeak and Seas

[57] ABSTRACT

For transporting and guiding delicate packaging material in conjunction with a packaging machine for producing individual blanks, a conveyor band 15 is subdivided by deflection into two portions 24, 25 is used. In the region between these conveying portions the sheet 12 or blank 10 is transported on a roller 26 acting as an intermediate conveyor. The severing cut is made here, without the continuous guidance of the sheet and blank being interrupted.

10 Claims, 6 Drawing Figures

Fig. 2
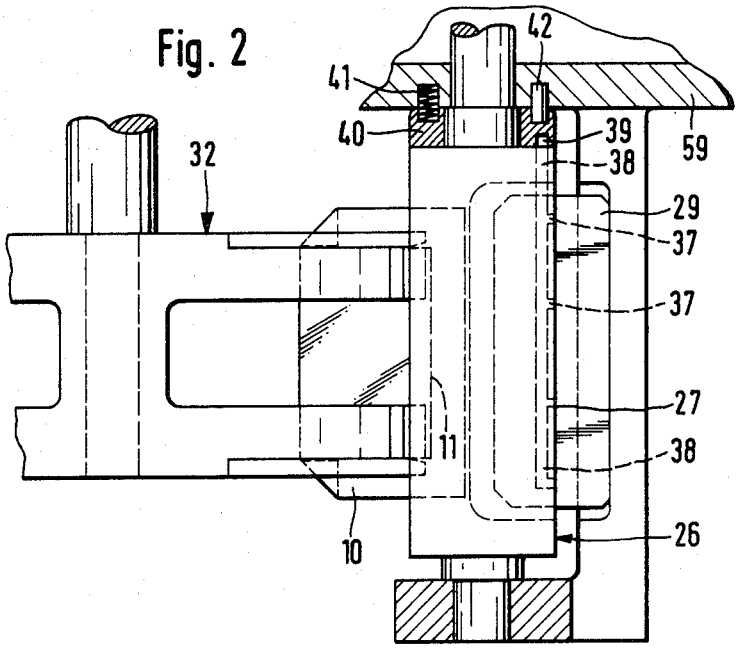
Fig. 4
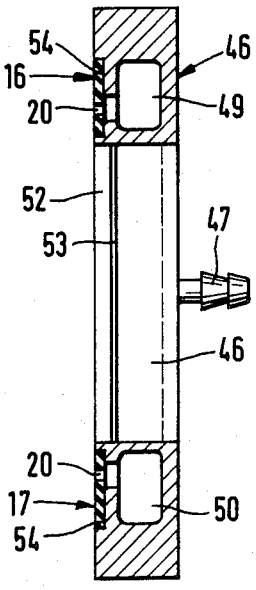
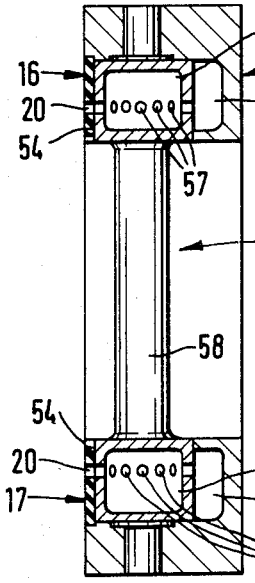
Fig. 5

APPARATUS FOR PRODUCING PACKAGING BLANKS

BACKGROUND OF THE INVENTION

This invention relates to an apparatus for producing packaging blanks by severing a continuous sheet, in which apparatus the sheet and the blank are transported and guided by revolving conveyor bands to which suction is applied in at least some regions.

The processing of delicate packaging material presents problems in the packaging industry. Thin-walled plastic foils require special measures regarding the transport and fixing of the packaging material until it is wrapped round the article to be enveloped. This is particularly true when such packaging materials are processed in high-performance packaging machines, for example, when cigarette packs are enveloped in an outer wrapper.

In a known apparatus of this type (U.S. Pat. No. 4,151,699), a necessary severing cut is made transversely to the sheet of packaging material to sever the individual blanks in successive part cuts. Preparatory cuts are made in the lateral region of the sheet, in the region of a first severing device, but these do not break the connection between the blank marked in this way and the sheet. A main cut is then made in the region of a second severing device, and this cut follows the preparatory cuts and severs the blank completely from the sheet. At the same time, the sheet and blank are transported over a part distance by conveyor bands to which suction is applied via suction holes and which fix the sheet and blank respectively by means of suction during transport. The main cut is made in the region of these conveyor bands and between them. As a result, an uninterrupted positive guidance of the sheet and the severed blanks is ensured until they are received by a cigarette pack.

SUMMARY OF THE INVENTION

Starting from this state of the art, the object on which the invention is based is to design an apparatus for producing blanks by severing from a sheet of packaging material, so that it has a simple construction and a reliable mode of operation, and to prevent the sheet from being severed completely so as to form the blank by means of part cuts.

To achieve this object, the apparatus according to the invention comprises the following features:

(a) The conveyor bands are sub-divided into conveying portions;

(b) between successive conveying portions there is an intermediate conveyor for the sheet and blank respectively, which connects these to one another;

(c) in the region of the intermediate conveyor there is a severing unit (cutting device) for severing the sheet.

Consequently, in the apparatus according to the invention, the blank is parted from the sheet in a single continuous severing cut directed transversely to the sheet. This severance takes place in the region of an intermediate conveyor which receives the sheet or the rear end of the severed blank periodically as an additional means of positive conveyance between the successive conveying portions of the conveyor bands. This intermediate conveyor is preferably a conveyor roller which is designed at the same time as a knife roller, particularly with a severing knife located on the periphery of its roller shell. This severing knife interacts with a fixed counterknife or a stationary rotating counterknife roller.

The conveyor belts are designed (in a way known per se) so that they are subjected, in the region of a conveying side, to suction air via suction holes for the purpose of fixing the sheet or blank respectively. In the region of the intermediate conveyor, the sheet is transferred to the periphery or roller shell of the conveyor roller and is fixed on this likewise by means of suction air. In the region of transfer from one conveyor to the other, the suction air in each case becomes ineffective as regards the sheet or blank to be transferred.

Alternatively, the conveying portions of the conveyor bands can be formed by interrupting the conveying side of a single common conveyor band, in which case the conveyor band is deflected in the region of the intermediate conveyor by means of deflecting rollers and at the same time is pressed by these against the periphery of the conveyor roller. Alternatively, two separate conveyor bands running towards the conveyor roller can be used. Here, one conveyor band preferably consists of two lateral narrow conveyor belts which are provided throughout with a series of suction holes in the region of the side edges of the sheet and of the blank.

Further features of the invention relate to the conveyor bands, the intermediate conveyor and the design of suction means for generating suction air directionally in the region of the conveyor bands.

BRIEF DESCRIPTION OF THE DRAWINGS

An exemplary embodiment of the invention is explained in more detail below with reference to the drawings, in which:

FIG. 2 shows a detail of the apparatus, namely a conveyor roller with further details, in a horizontal projection and a plan view respectively, FIG. 4 shows a horizontal section in the plane IV—IV of FIG. 1, FIG. 5 shows a horizontal section in the plane V—V of FIG. 1.

DETAILED DESCRIPTION OF THE PREFERRED EMBODIMENT

Figure 1:
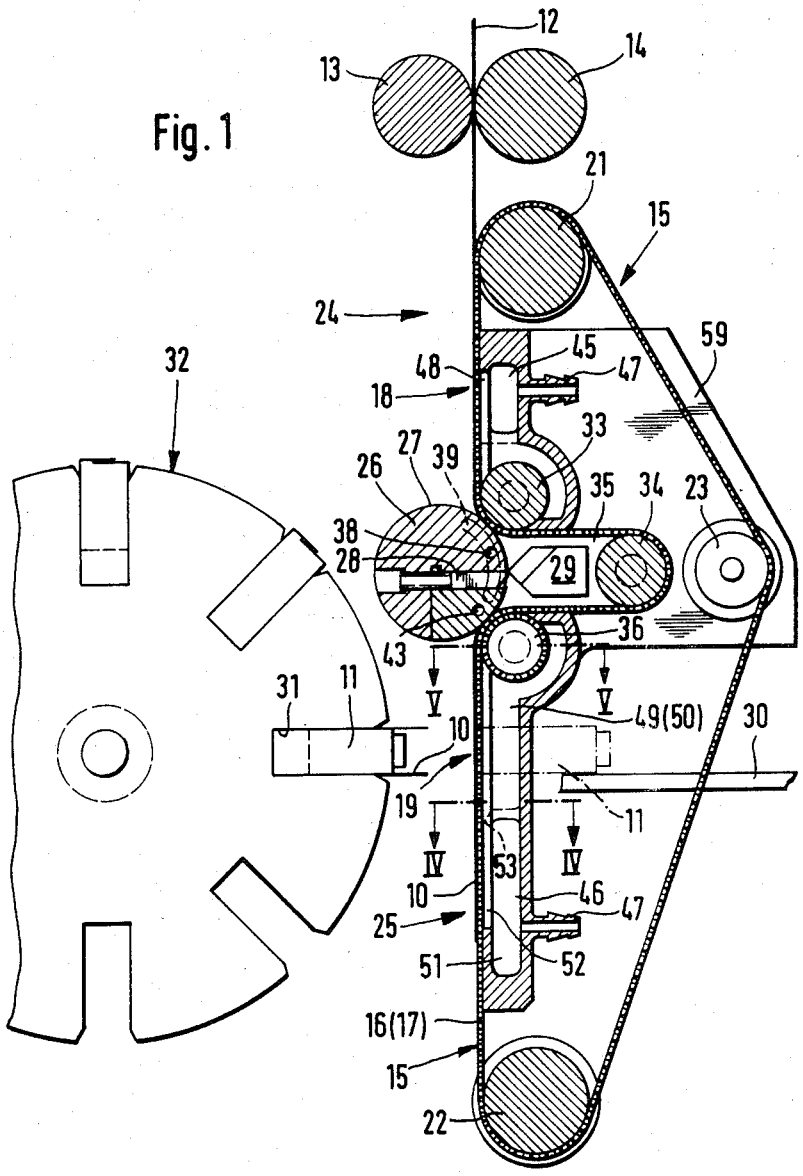
FIG. 1 shows an apparatus for producing and conveying blanks, in a diagrammatic side view and a vertical section respectively.

The apparatus illustrated in the drawings produces blanks 10 and feeds them as an outer wrapping to a cigarette pack 11. Accordingly, the packaging material is a transparent and extremely thin foil made of plastic.

The packaging material is fed as a continuous sheet 12. Tension rollers 13 and 14 ensure that the sheet 12 drawn off from a reel is transported.

Following the tension rollers 12, 13, the sheet 12 is received by a conveyor which ensures that the sheet 12 and the blank 10 severed from it are transported uninterruptedly until the latter is received by the pack 11. In the present exemplary embodiment, this purpose is served by a conveyor band 15 which is formed from two laterally guided conveyor belts 16 and 17. These are subjected to suction air in the region of conveying zones 18 and 19 to retain the sheet 12 or blank 10 on the belts 16, 17 during transport. For this purpose, the conveyor belts 16, 17 are provided, in the region where the edges of the sheet 12 or of the blank 10 press against them, with a continuous series of suction holes 20. These are spaced from one another in the direction of transport and are subjected to suction air on the side opposite the sheet or the blank.

The conveyor band 15 is guided over upper and lower deflecting rollers 21 and 22 arranged such that the conveying side 18, 19 for transporting the sheet 12 and blank 10 runs essentially vertically. A third offset deflecting roller 23 ensures trouble-free guiding of the conveyor band 15 in the non-conveying region.

The blanks 10 are severed from the sheet 12 in the region of an uninterrupted positive-conveyance stage, formed essentially by the conveyor band 15, and are conveyed further. To allow severing to be carried out by means of a complete severing cut, the conveyor band 15 is divided into at least two conveying portions 24 and 25. These are defined, by means of an interruption or diversion in the conveying side of the conveyor band 15, in such a way that the two conveying sides 18 and 19 are separated from one another.

To maintain uninterrupted positive conveyance of the sheet 12 and of the blank 10 respectively in the region between the conveying portions 24 and 25, an intermediate conveyor roller 26 is installed here. The sheet 12 fed by conveying side 18 is transferred to the conveyor roller 26, in particular is laid against its roller shell 27. The rotating conveyor roller 26 delivers blanks cut from the sheet 12 to the receiving or input end of the second conveying portion 25.

In the region of the conveyor roller 26, the blanks 10 are parted from the sheet 12 by a severing cut. For this purpose the conveyor roller 26 is also designed as a knife roller. A radially directed severing knife 28 built into the conveyor roller 26 projects slightly above the roller shell 27. As a result of momentary interaction with a stationary counterknife 29, the severing cut is made in the sheet 12. The dimensions, conveying speeds and relative positions are coordinated with one another in such a way that, as shown in FIG. 1, the severing cut is made approximately in the center between the conveying portions 24 and 25.

Immediately after the blank 10 has been severed, it is received by the pack 11 conveyed on a pack track 30 transversely to the plane of the blank 10, specifically as a result of the blank 10 being drawn off from the conveyor band 15 by slipping. In the course of the further transport movement of the pack 11, the blank 10 wraps itself around the latter in a U-shaped manner. The pack 11, after receiving the blank 10, is pushed into a pocket 31 of a folding turret 32. The folding of the blank 10 then continues here.

The conveying portions 24 and 25 are formed by the common conveyor band 15. Its conveying side 18, 19, is deflected, at the end of the first conveying portion 24, out of the vertical plane by an angle of 90° via a pressure roller 33. The conveyor band 15 then runs over an intermediate deflecting roller 34 which is set back in relation to the plane of the conveying side 18 and 19. The counterknife 29 is located in a gap 35 formed as a result.

From the intermediate deflecting roller 34, the conveyor band 15 leads back into the plane of the conveying side 18, 19 via a second pressure roller 36.

The two pressure rollers 33 and 36 are arranged approximately in a common vertical plane. In the region of the deflection of the conveyor band 15 by the pressure rollers 33 and 36, the conveyor roller 26 rests with its shell 27 against the conveyor band 15. The sheet 12 supplied in the region of the conveying side 18 is thereby brought up against the shell 27 of the roller 26 in the region of the pressure roller 33. The conveyor roller 26 transports the blanks 10 up against the continuing conveying side 19 in the region where the conveyor band is deflected at the pressure roller 36.

To ensure that the sheet 12 is transferred from the conveyor band 15 to the conveyor roller 26 and from this to the conveying side 19 without any faults, the sheet 12 and blank 10 are subjected to suction.

The roller 26 is provided along its periphery with suction bores 37. These are arranged in axial and parallel rows and are connected to a bore 38 within the roller 26 assigned to each row of suction bores 37. The connecting bores 38 extending in the vicinity of the roller shell 27 are connected to a suction segment 39 over a part region of the rotation of the conveyor roller 26, that is to say momentarily. This suction segment is conventionally formed as a groove, open on one side, in a fixed control ring 40 which is supported elastically by springs 41 and which is mounted non-rotatably and coaxially to the conveyor roller 26 by means of pins 42. The suction segment 39 extends over a region of rotation of the conveyor roller 26 facing the pressure roller 33, specifically beyond the location of the counterknife 29. However, the suction segment 39 ends before the region where the roller shell 27 rests against the pressure roller 36. Instead, a venting bore 43 is formed in the control ring 40 in this region. Consequently, the connecting bores 38 located in the region of the suction segment 39 exert, via the bores 37, a retaining force on the sheet 12 and the blank 10, while the connecting bores 38 in the region of the venting bore 43 release the blank without delay.

Figure 3:
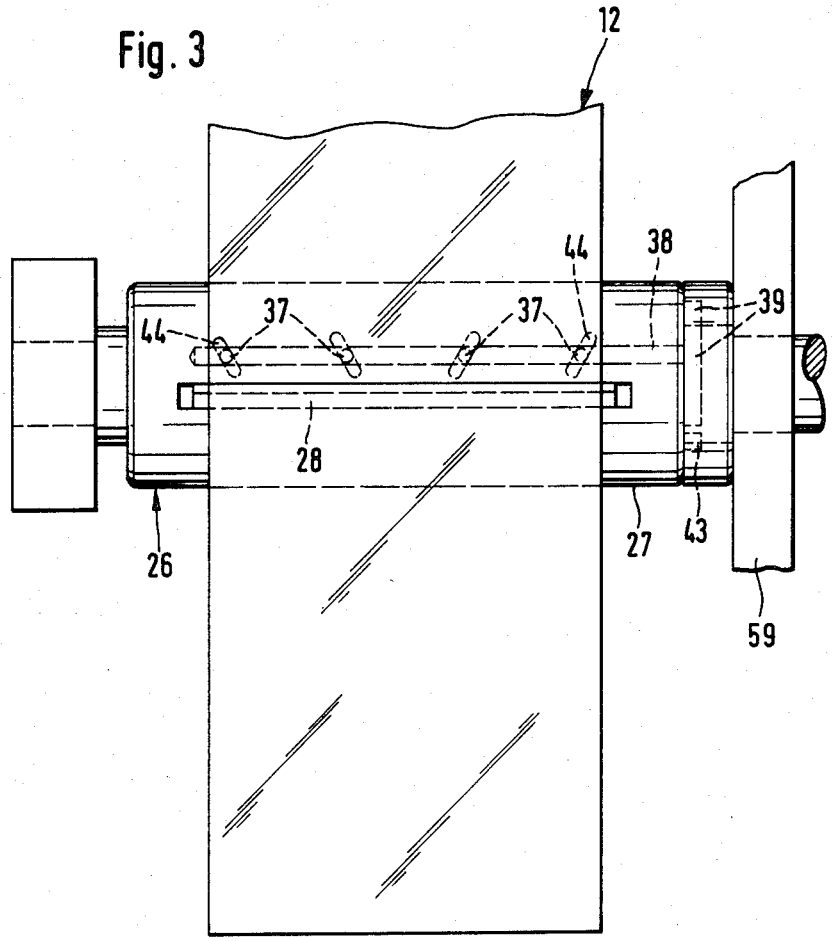
FIG. 3 shows a side view of the conveyor roller according to FIG. 2 in the region of a severing knife.
Figure 6:
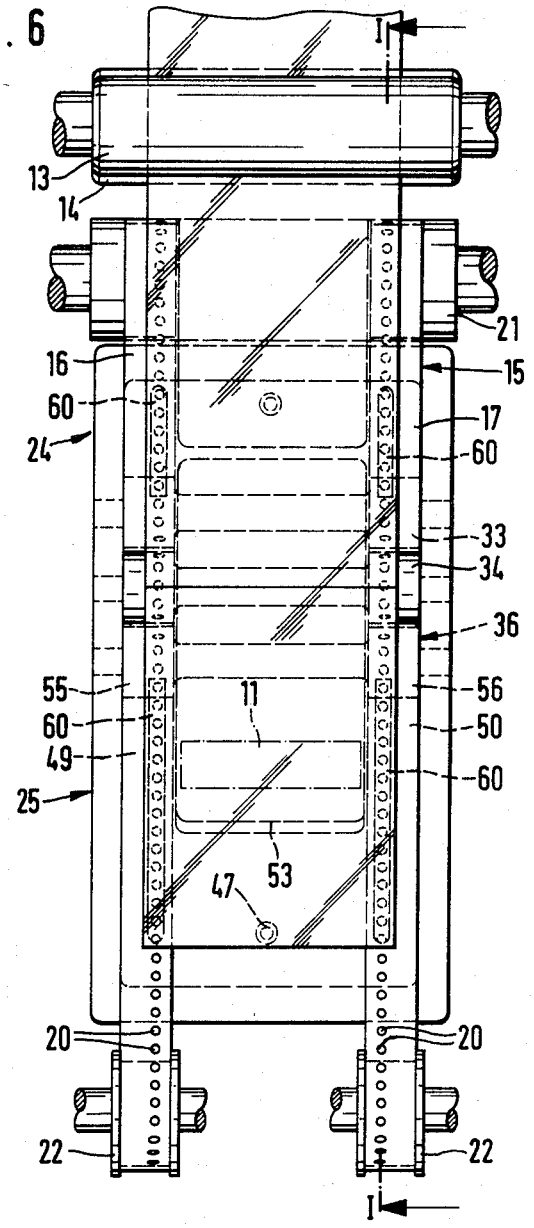
FIG. 6 shows a side view offset 90° in relation to FIG. 1, without an intermediate conveyor and a folding turret.

The pressure roller 33 is designed so that it does not exert any suction effect on the conveyor belt resting against it, and consequently has a smooth surface. Accordingly, the sheet 12 is transferred to the shell 27 of the conveyor roller 26 in a trouble-free manner because the sheet 12 is sucked against the shell 27 while at the same time being released in the region of the pressure roller 33. Conversely, the blank 10 is released by the shell 27 in the region of the pressure roller 36 and is received by the latter and the conveyor band 15 due to suction air. The bores 37 of the roller 26 are provided with elongate, slot-shaped mouths 44 (FIG. 3). These are arranged at an acute angle to the direction of conveyance of the sheet 12 or blank 10, specifically converging in the direction of movement. As a result, a spreading effect smoothing out in a transverse direction is exerted on the sheet 12 or the blank 10 via the suction air, so that any folds, distortions, etc., are eliminated. A smoothing effect in the conveying direction is achieved, in addition, because the roller 26 is preferably driven at a somewhat higher speed than the sheet 12 or blank 10.

The suction air is transmitted to the conveyor belts 16, 17 by separate suction chambers 45 and 46 connected to a suitable vacuum source (hose connection 47).

The upper suction chamber 45 is formed with a continuous undivided interior. A chamber wall 48 facing the conveying side 18 is provided, in the region of the suction holes 20, with suction slits 60 extending in the direction of the latter. The vacuum is transmitted to the conveyor belts 16, 17 via these.

The lower suction chamber 46 consists, at least in the region of conveyance of the pack 11 directed transversely to it, of two lateral elongate part chambers 49 and 50. In the lower region, these part chambers 49, 50 merge into a connecting chamber 51 extending over the full width. In the region of a chamber wall 52 facing the conveyor belts 16, 17, there is a sharp run-on edge 53 for the front end of the blanks 10.

As is evident especially from FIG. 4, the width of the part chambers 49, 50 corresponds approximately to the width of the conveyor belts 16, 17. Here, as in the region of the suction chamber 45, the conveyor belts 16, 17 are guided in groove-like recesses 54 in such a way that the outer face receiving the blank 10 or the sheet 12 is essentially flush with the chamber wall 48 or 52 respectively. The pressure roller 36 is also designed in a special way (FIG. 5). It consists of lateral individual rollers 55 and 56, each assigned to a conveyor belt 16 and 17 respectively. The rollers 55, 56 are hollow and are provided in the plane of the suction holes 20 with a ring of suction bores 57. The rollers 55, 56 are connected to one another by an axle piece 58. The rollers 55, 56 are located at least with their shell, having the suction bores 57 within the part chambers 49 and 50. On the inner side in an axial direction, the part chambers 49, 50 are limited by the rollers 55, 56. This arrangement ensures that the vacuum prevailing in the part chambers 49, 50 is transmitted to the interior of the rollers 55, 56 and consequently to the conveyor belts 16, 17 resting against their shells Accordingly, a separate vacuum source or a separate connection is not necessary for the pressure roller 36.

In the embodiment illustrated, the rollers 23, 26, 33, 34 and 36 are mounted laterally in or on a common machine wall 59. This is also a lateral limitation or holder of the suction chambers 45 and 46.

We claim:

1. An apparatus for severing packaging blanks (10) from a web (12) of thin, highly flexible wrapping material, such as cellophane wrappers for cigarette packs, comprising:

(a) a pair of laterally spaced, endless, fluid permeable belts (16, 17), (b) a plurality of spaced, axially parallel rollers (21–23, 33, 34, 36), including at least one driven roller, supporting the belts to define first and second successive coplanar conveyor runs (24, 25) separated by a diversion zone (35), (c) first knife means (29) disposed at the diversion zone and extending laterally across the full width of a web conveyance path thereat, (d) a conveyor roller (26) rotatably mounted at the diversion zone in surface contact with the belts at both an exit end of the first conveyor run and an entry end of the second conveyor run, said conveyor roller being provided with a plurality of suction holes (37), (e) second knife means (28) embodied in the conveyor roller, extending laterally across the full width of the web conveyance path, and cooperable with the first knife means to sever successive blanks from a web, (f) means for applying suction through the belts to regions of the first and second conveyor runs flanking the diversion zone, and through the holes to a peripheral sector of the conveyor roller extending substantially across the diversion zone, (g) means (13, 14) for continuously supplying the web to an entry end of the first conveyor run, and (h) means for removing severed blanks from the second conveyor run, whereby both the web and blanks severed therefrom are positively and continuously held against the first and second conveyor runs and against the peripheral sector of the conveyor roller during their transport and advancement through the diversion zone and the first and second knife means.

2. An apparatus as claimed in claim 1, wherein the second knife means comprises a transverse blade extending outwardly from the periphery of the conveyor roller, and wherein the first knife means is fixedly mounted.

3. An apparatus as claimed in claim 1, wherein the belts are deflected by an angle of approximately 90°, by upper and lower pressure rollers (33, 36) at the diversion zone.

4. An apparatus as claimed in claim 3, wherein the lower pressure roller (36) is disposed at the entry end of the second conveyor run (25) and is subjected to suction air, and the suction applied to the conveyor roller is vented at a region of transfer adjacent the lower pressure roller.

5. An apparatus as claimed in claim 1, wherein the belts are guided in the region of the conveyor roller over an intermediate deflecting roller (34) offset therefrom.

6. An apparatus as claimed in claim 1, wherein the surface of the conveyor roller is driven at a higher speed than that of the belts.

7. An apparatus as claimed in claim 1, wherein the suction holes (37) of the conveyor roller (26) have elongate slot-shaped mouths (44) oriented to diverge in the direction of conveyance of the web.

8. An apparatus as claimed in claim 1, wherein the suction applying means comprises a pair of suction chambers (45, 46) individually disposed behind the first and second conveyor runs and in communication with the belts through elongate slots (60) in walls (48, 52) of the chambers.

9. An apparatus as claimed in claim 8, further comprising means (30) disposed behind the second conveyor run for inserting a pack (11) between the belts and against a blank such that the blank is wrapped around the pack in a U-shape and removed from the belts, and wherein a lower one of the suction chambers includes two laterally spaced arms (49, 50) flanking the insertion means.

10. An apparatus as claimed in claim 9, wherein one of the rollers (36) is disposed at the entry end of the second conveyor run, has spaced hollow portions (55, 56) individually disposed behind the belts, is provided with apertures (57) in said hollow portions, and is in communication with the arms of the lower suction chamber.

* * * * *